US005996731A

United States Patent [19]

Czabala et al.

[11] Patent Number: 5,996,731

[45] Date of Patent: Dec. 7, 1999

[54] COMPRESSOR MUFFLER

[76] Inventors: Michael P. Czabala, 6090 Foxberry La., Roswell, Ga. 30075; Robert W. Murdoch, 5228 Willow Ridge Dr., Woodstock, Ga. 30188

[21] Appl. No.: 09/030,048

[22] Filed: Feb. 24, 1998

[51] Int. Cl.[6] ..... F02M 35/00

[52] U.S. Cl. ..... 181/229; 181/264

[58] Field of Search ..... 181/229, 214, 181/222, 224, 225, 249, 255, 264, 267, 269, 279, 280, 281; 55/385.3

[56] References Cited

U.S. PATENT DOCUMENTS 4,450,933 5/1984 Fukuoka et al. ..... 181/229
4,693,339 9/1987 Beale et al. ..... 181/229

*Primary Examiner*—Khanh Dang
*Attorney, Agent, or Firm*—Troutman Sanders LLP; Gerald R. Boss, Esq.

[57] ABSTRACT

A muffler assembly for muffling noises associated with a compressor. The muffler assembly includes an air intake having a hollow interior for receiving air from the ambient environment when the compressor is operating. A baffle is located within the interior of the intake for restricted passage of the air through the intake. A fluid portal is defined within the baffle for enabling fluid to pass from one side of the baffle to the other side of the baffle and subsequently through said air intake. An attenuator is disposed within the fluid portal for attenuating noise and the attenuator disturbs the soundwaves associated with the operation of the compressor.

24 Claims, 5 Drawing Sheets

COMPRESSOR MUFFLER

BACKGROUND OF THE INVENTION

This invention relates to a muffler system in general, and more particularly to an integrated muffler system for decreasing the noise level of a compressor and for manipulating the frequency of the soundwaves associated with the operation of a compressor to produce a more tranquil environment.

Compressors are utilized for compressing air at atmospheric pressure to a higher pressure for subsequent use. One such application is the use of a compressor with an oxygen concentrator where air is drawn in from the surrounding environment through the inlet port of the compressor and then compressed and passed through an outlet to the molecular sieves of the oxygen concentrator.

A compressor includes a housing which houses a fan assembly which draws air from the ambient environment to a piston assembly which compresses the air. Typically, the fan blades are exposed to the ambient environment. The piston assembly generally consists of a compressor head connected to a valve plate, a piston sleeve connected to the valve plate, and a piston within the piston sleeve which moves in an up and down cycle. The compressing of the air generates noise from a variety of sources. Typically, running of the fan is not muffled and also the sucking of air into the compressor by the downstroke of the piston generates noise through the intake port. Many pistons utilize a reed valve in the valve plate for directing the airflow in and out of the compressor. The air flowing through the reed valve generates a sound which is continually repeated as a result of the reciprocating motion of the piston. Furthermore, the compression of air by the upstroke of the piston generates a noise which travels back through the intake port while the turbulent flow of the air as it travels at high velocity into an output cylinder also generates acoustic noise in a pulse setting fashion. Accordingly, a muffler is generally connected somewhere in the compressor system for muffling the noise of the compressor.

Several attempts have been made to develop a muffler for compressors. Previously, some efforts have included placing foam filters within enclosed chambers forcing the air through the filters. While such mufflers generally filter very high frequencies, they have little affect on lower frequency sounds. Furthermore, these assemblies require numerous parts and typically occupy a large amount of space which impact the desirability of the muffler. Such an assembly is shown in FIG. 1. Another possible disadvantage with such a design is that a trade-off exists between adequately muffling the noise and producing a pressure drop across the muffler which decreases the efficiency of the compressor.

Other attempts to reduce compressor noise have utilized non-dissipative mufflers for reducing sound within a specific frequency range. Such mufflers utilize a resonator which are tuned to maximize the amount of attenuation by adjusting the length and diameter of the outlet with respect to the sides of the cylinder chamber. While these types of resonators are effective, they generally require extensive design work on the particular compressor size and then only work on soundwaves of a particular frequency.

While many of these mufflers do reduce the compressor noise, they are generally either difficult to design, only effectively reduce the sound associated with a particular wave frequency, or require many components which result in an increase cost of the muffler in both materials and assembly labor.

Therefore there is a need for an improved compressor muffler for a pneumatic compressor and especially for a compressor which is utilized in the home environment for establishing a sound spectrum which is not intrusive to the hearing of individuals.

Accordingly, it is an object of the present invention to provide a muffler assembly which is easy to manufacture;

Additionally, it is an object of the present invention to provide a muffler assembly which decreases the overall decibel level of the compressor and also improves the sound quality of the noise associated with the compressor;

Furthermore, it is an object of the present invention to provide a muffler assembly which includes a suspended attenuator for reducing the overall decibel level of the compressor by manipulating the amplitude and frequency of the soundwaves associated with a pneumatic compressor;

Furthermore, it is an object of the present invention to provide an effective muffler which does not significantly effect the overall size of a compressor or the cost of manufacturing the compressor;

It is also an object of the present invention of the present invention to provide an effective muffler which does not create a sufficient pressure drop reducing the efficiency of the compressor.

SUMMARY OF THE INVENTION

The above objectives are accomplished according to the present invention by providing an integrated muffler assembly for a compressor which reduces the noise created by the compressor's operation. The muffler assembly includes an air intake having a hollow interior for receiving air from the ambient environment when the compressor is operating. The air communicates with an acoustical distortion chamber which is larger than the air intake for distorting the frequency of the airwaves. A muffler housing defines the acoustical chamber. The muffler housing includes a flange for attaching directly to the compressor for hermetically sealing the compressor inlet reducing noise from the compressor from entering the ambient environment. An air outlet extends from the muffler housing into the interior of the compressor for presenting air for compression by a piston assembly.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Figure 1:
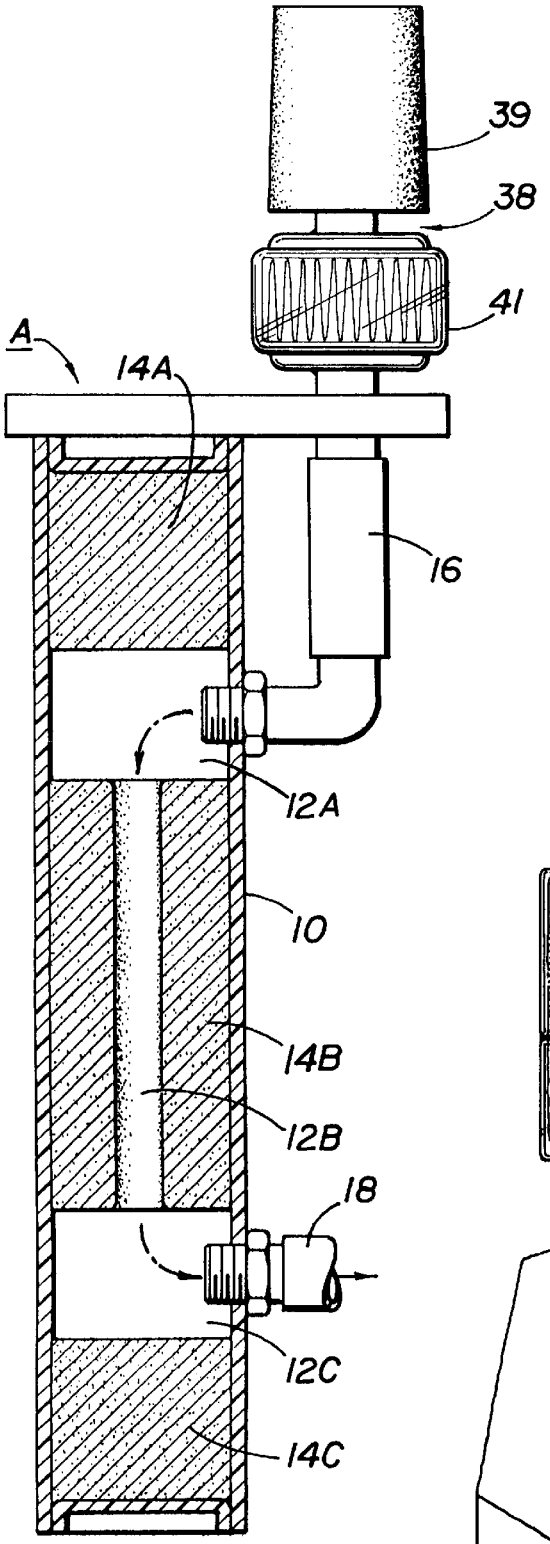
(PRIOR ART) FIG 1
FIG. 1 is a view of a prior art muffler.

Referring now to the drawings, the invention will be described in more detail. FIG. 1 illustrates prior art muffler A. Prior art muffler A is designed to be utilized with a standard compressor such as a compressor provided by Thomas Industries of Sheboygen Wis. Prior art muffler A includes cylindrical housing 10 which encloses three chambers 12*a,* 12*b,* and 12*c* which are defined between foam filters 14*a,* 14*b* and 14*c.* Muffler inlet 16 communicates air into the muffler and muffler outlet 18 communicates air from the muffler to the compressor. This design utilizes several components which affect the cost of the muffler assembly and utilizes a lot of space which is disadvantageous for compact oxygen concentrator units which are intended for home use.

Figure 2:
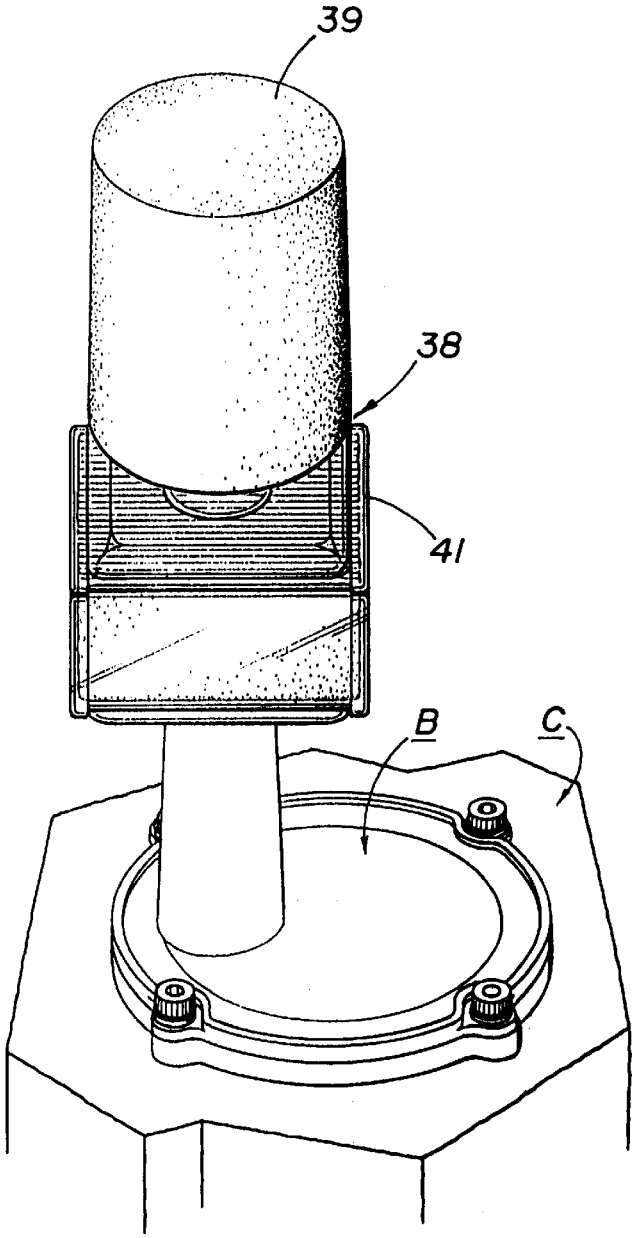
FIG. 2 is a perspective view of a muffler assembly according to the present invention integral with a compressor housing.

As shown in FIG. 2, muffler assembly B is designed for being integrated with compressor housing C. Compressor housing C houses a general piston assembly for receiving air and compressing the air for subsequent use. In the preferred embodiment, the compressor is manufactured by Thomas Industries of Sheboygan, Wis. and is utilized as a source of pressurized air for subsequent use which may either be an oxygen concentrator or home care respirator. Compressor housing C includes a compressor inlet 20 through which air is received into the compressor. Muffler assembly B is configured for matingly adapting to compressor housing C in a hermetic manner for assisting in the efficiency of the compressor and also for preventing noise from the compressor from pervading through the ambient environment.

Figure 3:
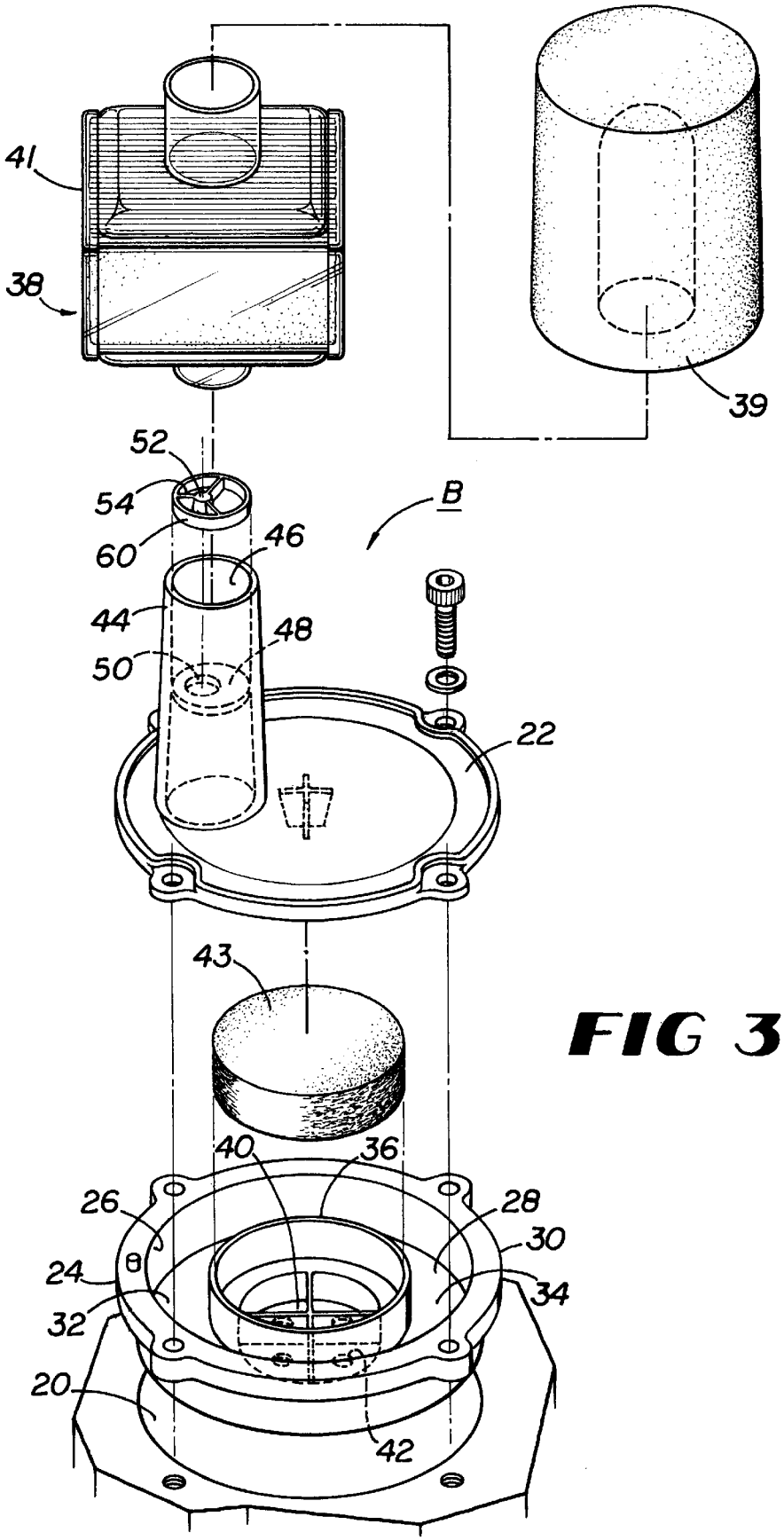
FIG. 3 is an exploded view of a muffler assembly according to the present invention.
Figure 6:
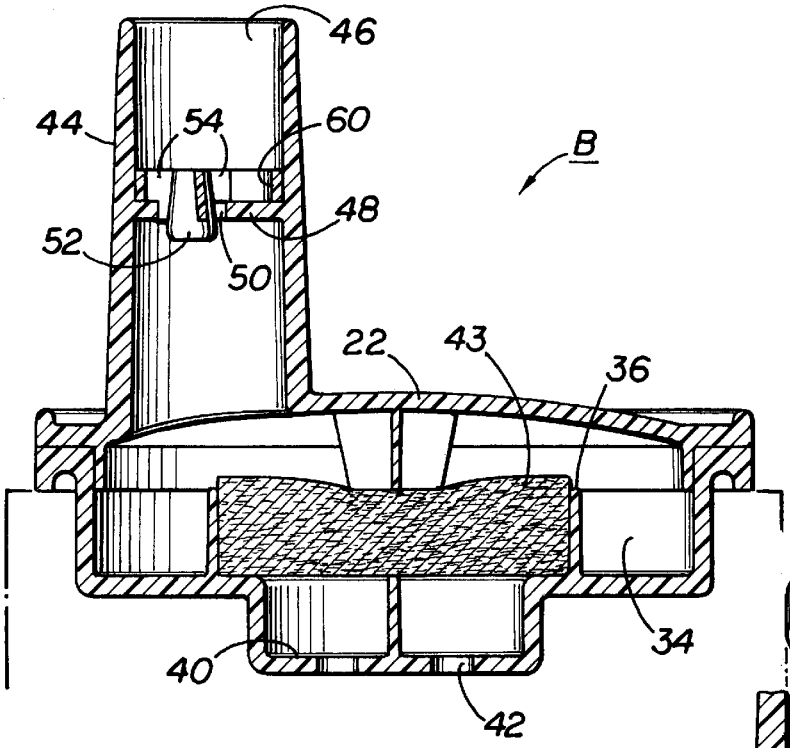
FIG. 6 is a sectional view of a muffler assembly according to the present invention taken along sectional line 6—6 of FIG. 5.

As shown in FIGS. 3 and 6, muffler assembly B provides a tortuous path for air flowing from the ambient environment into the compressor. Muffler assembly B includes upper muffler housing member 22 and lower muffler housing member 24. As shown in FIGS. 3 and 6, upper muffler housing member 22 attaches to flange 30 for enclosing acoustical distortion chamber 34. Upper muffler housing member 22 carries air intake conduit 44 which defines air intake passageway 46 which fluidly communicates with acoustical distortion chamber 34. Air intake conduit 44 has a smaller cross section than acoustical distortion chamber such that air flow which passes from air intake conduit 44 into acoustical distortion chamber 34 is distorted.

In the preferred embodiment, air intake conduit 44 is tubular but may consist of any elongated geometric design such as a rectangle or the like. Disposed within the interior of air intake conduit 44 is baffle 48 which defines fluid portal 50. Baffle 48 transverses the interior of air intake conduit 44 for restricting the air flow within air intake passageway 46 and directing the air flow through fluid portal 50. An attenuator 52 is suspended within fluid portal 50 for disturbing the airflow through air intake 44. Filter assembly 38 matingly attaches to the top of air intake conduit 44 for filtering out large and small particles from the ambient environment prior to entry into the compressor. Filter assembly 38 includes a first filter 39 for filtering large particles and HEPA filter 41 which removes smaller particles.

As shown in FIGS. 3 and 6, lower muffler housing member 24 includes a general body having an outer sidewall 26 defining hollow interior 28. Flange 30 extends generally perpendicular from the top of outer sidewall 26 providing a mating surface for attaching to compressor housing C and covering compressor inlet 20. Outer sidewall 26 terminates at bottom muffler wall 32 for enclosing hollow interior 28 which defines acoustical distortion chamber 34. Air outlet conduit 36 is disposed within hollow interior 28 and extends upward into acoustical distortion chamber 34 and downward past bottom muffler wall 32 a general distance. Air outlet conduit 36 has a smaller cross section than acoustical distortion chamber 34 for further distorting airflow. Air outlet conduit 36 includes a bottom outlet wall 40 which is porous including a plurality of outlet ports 42 enabling air to pass through muffler assembly B and into compressor inlet 20. Outlet ports 42 are dispersed at different locations at different quadrants with respect to filter 43 enabling a large area of filter 43 to be utilized for filtering. Outlet ports 42 are of a sufficient size to prevent a back flow of pressure from air traversing through air outlet conduit 36 but do not in combination define an opening which enables significant level of noise from the compressor to pass into the compressor. Filter 43 is carried within air outlet conduit 36 for dampening sound which passes from the interior of the compressor through outlet ports 42.

As illustrated in FIG. 6, fluid portal 50 is smaller than the interior of air intake conduit 44. Attenuator 52 is disposed within fluid portal 50 for attenuating sound waves which travel through air intake conduit 44 and through fluid portal 50. In the preferred embodiment, attenuator 52 is suspended by a plurality of attenuator support ribs 54 which extend from the periphery of the fluid portal 50 toward the center of the fluid portal. In the preferred embodiment, attenuator 52 is conical with an increasing cross-section. Also in the preferred embodiment, the volume left unencumbered by the attenuator within the fluid portal is at least equal to the volume of the smallest orifice within the compressor assembly such that no back log of fluid pressure will occur within the muffler assembly.

Figure 4:
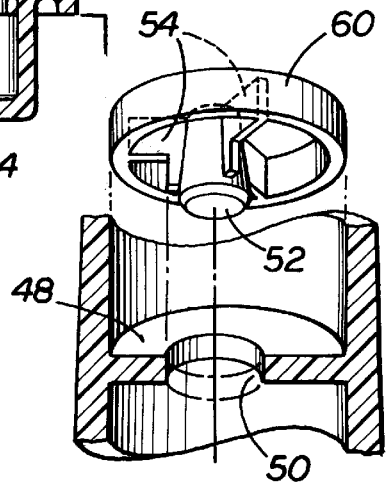
FIG. 4 is a close-up view of an attenuator assembly according to the present invention.
Figure 5:
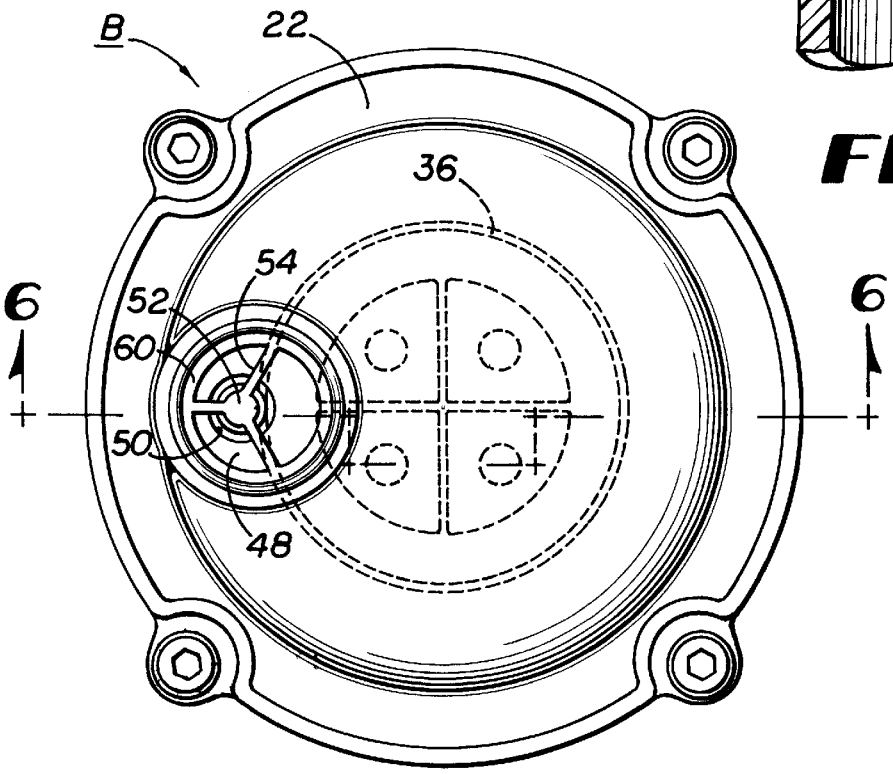
FIG. 5 is a top view perspective of the muffler assembly according to the present invention.

As shown in FIG. 4, attenuator 52 and attenuator support ribs 54 are carried by a rim 60 constituting an attenuator assembly. In the preferred embodiment, attenuator assembly is molded from a unitary plastic member and is positioned within air intake conduit 44 such that rim 60 rests on baffle 48 with attenuator support ribs 54 traversing baffle 48 enabling attenuator 52 to be suspended within fluid portal 50. Other various designs may be employed for supporting attenuator 52 within fluid portal 50.

In operation, the airflow from the ambient environment into the compressor passes through several sized chambers. First, the air passes through air intake 44 and through the smaller fluid portal 50 whereby attenuator 52 attenuates the soundwaves. Air then passes into air intake 44 into distortion chamber 34 which is larger than air intake 44. From the distortion chamber, air passes into air outlet conduit 36 which is smaller than distortion chamber 34 but larger than air intake 44 and through filter 43. After passing through filter 43, the air is channeled through outlet ports 42. The combination of the different sized chambers with attenuator 52 produces a sound spectrum which is non-irritating to a person. Furthermore, by hermetically attaching muffler assembly B with compressor housing C and utilizing an o-ring, internal sounds from the operation of the compressor are also restricted from passing into the ambient environment. Furthermore, filter 43 suppresses sound waves which travel from the compressor inlet through outlet ports 42.

The result of partially obstructing fluid portal 50 is that the soundwaves which are incurred through operation of the compressor are disturbed such that the amplitude of the respective soundwaves are diminished and the overall frequency spectrum of soundwaves are transformed such that the longer wave lengths are truncated to produce shorter wave lengths. The transformation and modulation of the soundwaves is produced by the obstruction which dissect the baffle orifice. The overall influence of the attenuator on the soundwaves is exhibited in FIGS. 7 and 8.

Figure 7:
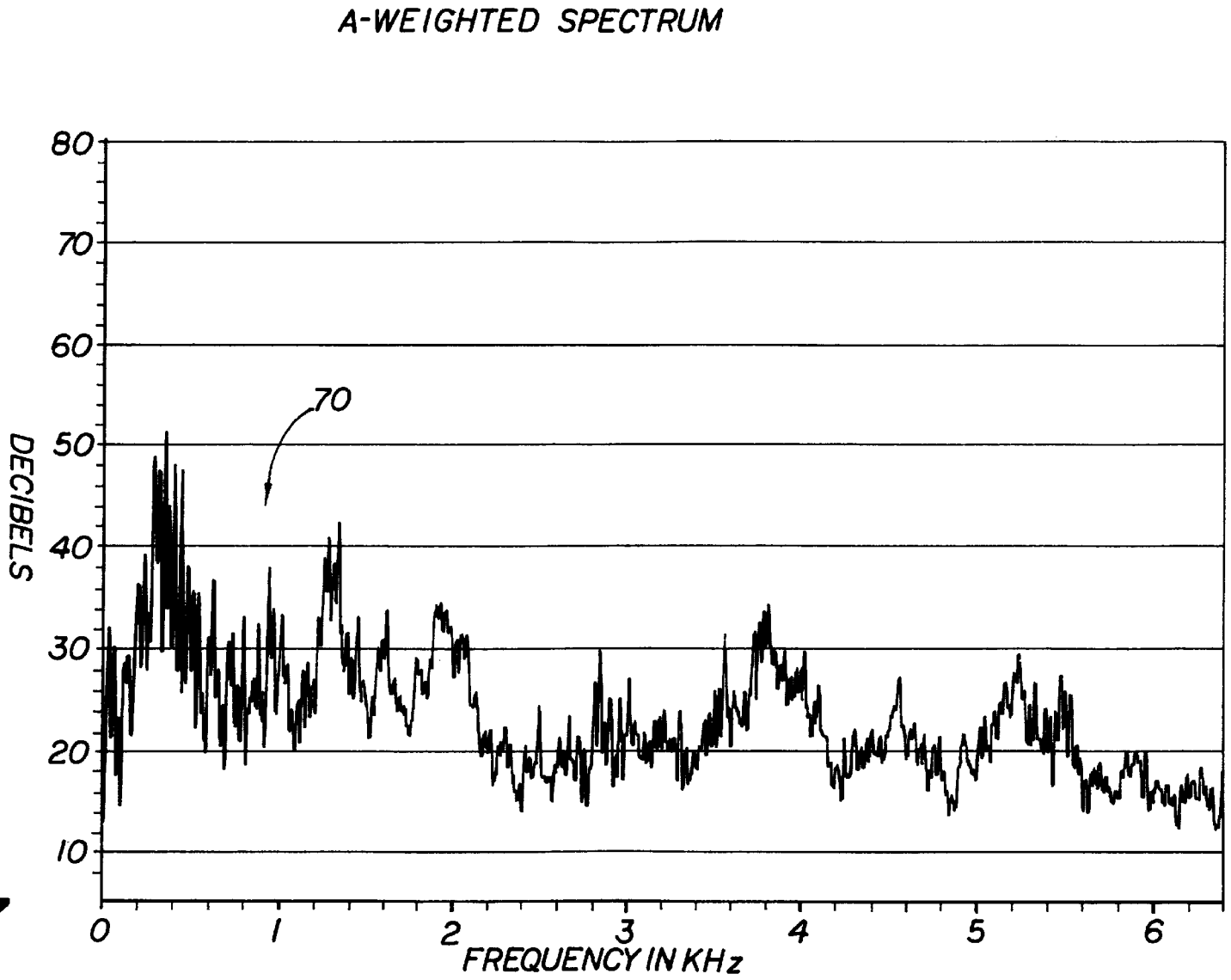
FIG. 7 is a chart illustrating the soundwave spectrum of a standard compressor utilizing a muffler assembly of similar design as the present invention but which does not include an attenuator.
Figure 8:
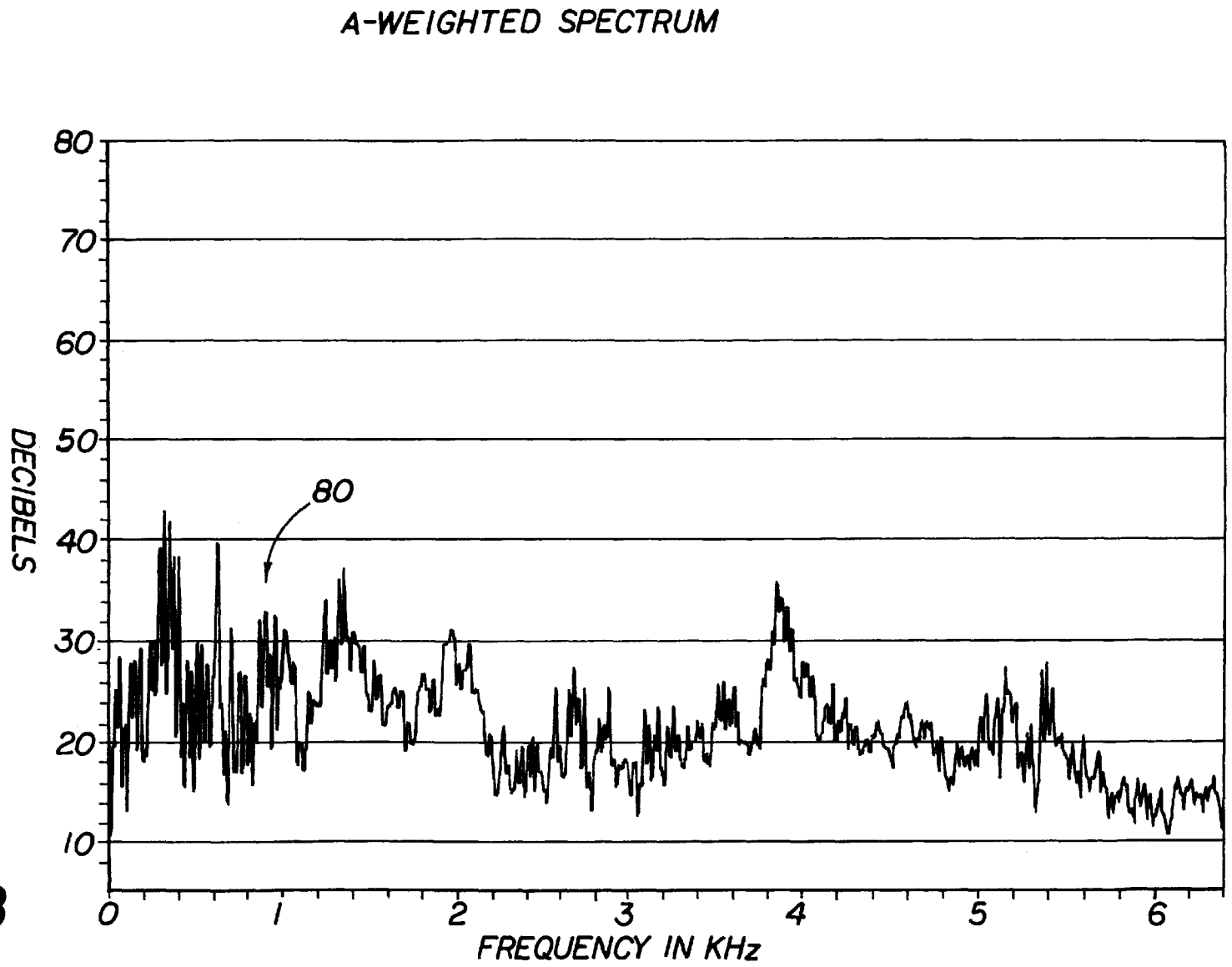
FIG. 8 is a chart illustrating the soundwave spectrum of a standard compressor utilizing a muffler assembly according to the present invention which includes an attenuator.

To illustrate the advantage of the attenuator, tests were run under similar conditions utilizing a compressor and a muffler assembly whereby the sound levels were recorded. FIG. 7 illustrates the spectrum of the soundwaves of an embodiment of a muffler assembly similar to muffler assembly B except it lacked an attenuator such as attenuator 52. FIG. 8 illustrates the spectrum of the soundwaves of an embodiment of muffler assembly B with attenuator 52. Both spectrums measure the occurrence of frequencies along the X-axis and the adjusted A-weighted sound level along the Y-axis. An A-weighted scale is common in the acoustical field for indicating the overall noise level of the sound. The premise behind an A-weighted scale is that the human ear does not respond equally to frequencies, but is less efficient at low and high frequencies than it is at medium frequencies with lower and higher frequencies being more irritating to a person. Thus, to obtain a single number representing the sound level of a noise containing a wide range of frequencies in a manner representative of the ear's response and overall comfort level, it is necessary to reduce the effects of the low and high frequencies with respect to the medium frequencies. The resultant sound level is said to be A-weighted.

As shown in FIG. 7 the non-attenuated muffler produced a sound spectrum which has an A-weighted sound level of fifty-eight point eight dBA. However, the attenuated muffler A as illustrated in FIG. 8 produced a sound spectrum which has an A-weighted sound level of fifty-three point eight dBA resulting in a reduction of five dBA. As noted by an OSHA study, a five dBA noise reduction equates to an environment which is about thirty percent quieter and represents a fifty percent decrease in the risk of hearing loss.

Also, as illustrated by FIGS. 7 and 8, when comparing the respective sound spectrums it is shown that the A-weighted dBA level for frequencies equal or less than one thousand hertz is significantly reduced illustrating that the attenuator has disturbed wavelengths of these frequencies in both amplitude and frequency and transferring the energy to wavelengths of other sizes. The importance of this feat is that the human ear can better tolerate noise within a medium frequency range instead of at high or low frequencies and also these frequencies can be better filtered by filters.

The pressure drop resulting from use by assembly B vary depending on the inclusion of attenuator 52 and filter 43. When an attenuator and filter were included within the muffler assembly, the pressure drop was approximately twenty-six point two inches of water. When muffler assembly B did not include filter 43, but did include attenuator 52, the pressure drop was approximately nineteen point six inches of water. When no attenuator was present but filter 43 was utilized, a pressure drop of approximately eleven point nine inches of water resulted. When no filter 43 or attenuator 52 was utilized, the pressure drop in assembly B was approximately six point two inches of water. Thus, the overall assembly does not impact the efficiency of the system.

Thus, it may be seen that an advantageous design for a compressor muffler may be had by employing an attenuator which is suspended within a restricted air passage for disturbing the airflow. The positioning of the attenuator results in a sound spectrum with a reduced A-weighted dBA scale resulting in less noise and a noise level which is comfortable with respect to the ambient environment.

What is claimed is:

1. A muffler assembly for a compressor for reducing noise created by operation of said compressor, said compressor including an intake port for intaking air for subsequent compression, said muffler assembly comprising:

an air intake having a hollow interior for receiving air from the ambient environment when said compressor is operating;

a baffle transversing said hollow interior of said air intake for restricting the passage of air through said air intake;

a fluid portal defined within said baffle for enabling an airstream to pass from one side of the baffle to the other side of the baffle and through said air intake;

said baffle defining the outer periphery of said fluid portal; and an attenuator disposed within the periphery of said fluid portal being offset from said periphery for disturbing said airstream for attenuating noise.

2. The assembly of claim 1 wherein said fluid portal is concentric with said air intake.

3. The assembly of claim 1 wherein said attenuator includes attenuator support ribs disposed within said fluid portal for disturbing the airflow through said air intake.

4. The assembly of claim 1 wherein said attenuator includes an elongated member disposed within said fluid portal.

5. The assembly of claim 4 wherein said elongated member is conical.

6. The assembly of claim 1 wherein said attenuator is suspended within said fluid portal.

7. The muffler assembly of claim 1 wherein said assembly includes a compressor interface includes a distortion chamber having a cross-section larger than the cross-section of said air intake, said air intake communicating with said distortion chamber.

8. The muffler assembly of claim 1 wherein said assembly produces A-weighted sound spectrum less than fifty-eight dBA.

9. A muffler assembly for a compressor for reducing noise created by operation of said compressor, said compressor including an air intake port for intaking air for subsequent compression, said muffler assembly comprising:

a housing having a hollow interior defining an acoustical distortion chamber;

said housing having a cross section larger than said air intake port of said compressor for enclosing said air intake port when carried by said compressor;

an air intake carried by said housing having a hollow interior defining an air passageway in fluid communication with said acoustical distortion chamber;

a baffle disposed within said air intake traversing said air intake hollow interior, said baffle defining a fluid portal enabling an airstream to pass from one side of said baffle to the other side of said baffle;

said baffle defining the outer periphery of said fluid portal;

an attenuator disposed within the periphery of said fluid portal being offset from said periphery for disturbing said airstream flowing through said fluid portal; and an air outlet carried by said housing permitting airflow to exit said acoustical distortion chamber and enter said air intake port of said compressor.

10. The muffler assembly of claim 9 wherein said fluid portal is concentric with said air intake.

11. The assembly of claim 9 wherein said attenuator includes attenuator support ribs disposed within said fluid portal for disturbing the airflow through said air intake.

12. The assembly of claim 9 wherein said attenuator includes an elongated member disposed within said fluid portal.

13. The assembly of claim 12 wherein said elongated member is conical.

14. The assembly of claim 9 wherein said attenuator is suspended within said fluid portal.

15. The assembly of claim 9 wherein said air outlet includes a conduit extending from said housing into said air intake port of said compressor and said housing includes a flange for enclosing said air intake port.

16. The muffler assembly of claim 9 wherein said assembly produces A-weighted sound spectrum less than fifty-eight dBA.

17. A muffler assembly for a compressor for reducing noise created by operation of said compressor, said compressor including an intake port for intaking air for subsequent compression, said muffler assembly comprising:

a housing having a hollow interior defining an acoustical distortion chamber;

said housing having a flange for covering said air intake port when carried by said compressor;

an air intake carried by said housing having a hollow interior defining an air passageway in fluid communication with said acoustical chamber;

a baffle disposed within said air intake transversing said air intake hollow interior, said baffle defining a fluid portal enabling air to pass from one side of said baffle to the other side of said baffle;

an attenuator disposed within said fluid portal for disturbing airflow flowing through said fluid portal;

said attenuator including an elongated attenuating member suspended within said fluid portal for modulating soundwaves passing through said fluid portal;

an air outlet conduit carried by said housing, said air outlet conduit including a top portion extending into said acoustical distortion chamber;

a filter carried within said air outlet;

said air outlet conduit including an air outlet bottom wall; and a plurality of outlet ports defined by said air outlet bottom wall permitting airflow to exit said acoustical distortion chamber and enter said air intake port of said compressor.

18. The muffler assembly of claim 17 wherein said attenuator decreases the A-weighted sound spectrum of the compressor when operating by at least 5 dBA from a similar muffler assembly without an attenuator.

19. The muffler assembly of claim 17 wherein said assembly produces A-weighted sound spectrum less than fifty-eight dBA.

20. The muffler assembly of claim 17 wherein the pressure drop between said air intake and said plurality of outlet ports is not greater than twenty-eight inches of water.

21. A muffler assembly for a compressor for reducing noise created by operation of said compressor, said compressor including an intake port for intaking air for subsequent compression, said muffler assembly comprising:

a housing having a hollow interior defining an acoustical distortion chamber, said acoustical distortion chamber having a general width;

said housing having a flange for covering said air intake port when carried by said compressor;

an air intake carried by said housing having a hollow interior of a general width defining an air passageway in fluid communication with said acoustical chamber;

said acoustical distortion chamber having a width greater than the width of said air intake port for disturbing sound waves passing from said air intake port into said acoustical distortion chamber;

an air outlet conduit carried by said housing, said air outlet conduit including a top portion extending into said acoustical distortion chamber;

a filter carried within said air outlet;

said air outlet conduit including an air outlet bottom wall; and a plurality of outlet ports defined by said air outlet bottom wall permitting airflow to exit said acoustical distortion chamber and enter said air intake port of said compressor.

22. The muffler assembly of claim 21 wherein the pressure drop between said air intake and said outlet port is not greater than thirteen inches of water.

23. A muffler assembly for a compressor for reducing noise created by operation of said compressor, said compressor including an intake port for intaking air for subsequent compression, said muffler assembly comprising:

an air intake having a hollow interior for receiving air from the ambient environment when said compressor is operating;

a baffle transversing said hollow interior of said air intake for restricting the passage of air through said air intake;

a fluid portal defined within said baffle for enabling fluid to pass from one side of the baffle to the other side of the baffle and through said air intake;

an attenuator disposed within said fluid portal for attenuating noise; and wherein said assembly produces A-weighted sound spectrum less than fifty-eight dBA.

24. A muffler assembly for a compressor for reducing noise created by operation of said compressor, said compressor including an air intake port for intaking air for subsequent compression, said muffler assembly comprising:

a housing having a hollow interior defining an acoustical distortion chamber;

said housing having a cross section larger than said air intake port of said compressor for enclosing said air intake port when carried by said compressor;

an air intake carried by said housing having a hollow interior defining an air passageway in fluid communication with said acoustical distortion chamber;

a baffle disposed within said air intake traversing said air intake hollow interior, said baffle defining a fluid portal enabling air to pass from one side of said baffle to the other side of said baffle;

an attenuator disposed within said fluid portal for disturbing airflow flowing through said fluid portal;

an air outlet carried by said housing permitting airflow to exit said acoustical distortion chamber and enter said air intake port of said compressor and;

wherein said assembly produces A-weighted sound spectrum less than fifty-eight dBA.

* * * * *